United States Patent [19]

Salvarezza

[11] 3,945,067

[45] Mar. 23, 1976

[54] QUICK-RELEASE STORAGE OF A LIFE RING AND LIFEBUOY MARKERS

[76] Inventor: Robert M. Salvarezza, 110 Braemar Drive, Hillsborough, Calif. 94010

[22] Filed: Feb. 4, 1975

[21] Appl. No.: 546,880

[52] U.S. Cl. ..... 9/14; 114/190

[51] Int. Cl.[2] ..... B63C 9/22

[58] Field of Search ..... 9/14, 8.3 R, 8.3 E, 9; 114/190

[56] References Cited

UNITED STATES PATENTS

| | | | |
|---|---|---|---|
| 2,528,837 | 11/1950 | Linhardt, Jr. | 9/8.3 R |
| 3,675,257 | 7/1972 | Haglund et al. | 9/14 |

FOREIGN PATENTS OR APPLICATIONS

| | | | |
|---|---|---|---|
| 1,506,328 | 6/1969 | Germany | 9/14 |

*Primary Examiner*—Trygve M. Blix
*Assistant Examiner*—Sherman D. Basinger
*Attorney, Agent, or Firm*—Owen, Wickersham & Erickson

[57] ABSTRACT

A quick-release device for storing a ring buoy and lifebuoy markers. The ring buoy rests against the end wall of a frame and is normally held there by a swingable pivoted ramp with its center of gravity well beyond the pivot. When stowed, the ramp snugly holds the ring buoy. The ramp also carries open-top, closed-bottom holders for lifebuoy markers. The markers may include a light signal and a smoke signal, both having actuators connected to a painter line, which is likewise stowed. A simple upward pull on a latch releases the ramp to seek its natural center of gravity, swinging out around its pivot providing a ramp pathway projecting the ring buoy out and away from a vertical drop and causing it to describe a trajectory that frees it from the ship. At the same time, the device both ejects and actuates the lifebuoy markers.

4 Claims, 8 Drawing Figures

QUICK-RELEASE STORAGE OF A LIFE RING AND LIFEBUOY MARKERS

BACKGROUND OF THE INVENTION

This invention relates to a quick-release device for a life ring which simultaneously ejects and actuates lifebuoy marker means. This invention is an improvement over U.S. Pat. No. 3,675,257. By means of that invention, a life ring or ring buoy is propelled into the water from a ship when an operator pulls a simple release handle. The propelling force results solely from a novel use in this environment of the force of gravity to give improved operability and better propulsion.

The U.S. Coast Guard requires that a flare, light, or smoke signal accompany the ring buoy and be connected to it by a painter line. Devices heretofore in use, while complying with the requirements, have supported the smoke or flare signal or light in such a position on the ship that the pull on it from the life ring through the painter line is at right angles to the direction required to free the signal and pull it out, relying on a sufficient force component to achieve the result. Since the life rings are quite light in weight, the force component has often proven unsatisfactory. Even at best, it has slowed down the fall of the life ring and made it more subject to action by the wind. Even U.S. Pat. No. 3,675,257, though a considerable improvement in this matter over the earlier art, still supported the flare or light or smoke signal by a pair of pressure clips and relied on the painter line to jerk the lifebuoy marker free from the clips.

SUMMARY OF THE INVENTION

As in U.S. Pat. No. 3,675,257, the invention provides a bracket for holding a ring buoy in the proper position on the ship, for example, along an axis transverse to the fore-and-aft axis of the vessel, typically aft of the bridge wing and just below the bridge railing. The bracket holds the life ring at a spaced distance away from the supporting bulkhead or railing, so that it will not come against that bulkhead or railing when it is released. It also supports a lifebuoy marker, such as a smoke or light signal, or both, and the painter line connecting the ring buoy to that signal. A pivoted ramp is used to retain the ring buoy: when in retention position, the ramp has a vertical portion locking the ring buoy in position and connected to a horizontal bottom portion by an inclined portion, generally at 45°. The ramp is pivoted well to one side of its center of gravity. A simple mechanical handle release has a latch that normally locks the ramp in place, and when the handle is pulled, the force of gravity causes the pivoted ramp to swing out and down and causes the life ring to move out with it and to roll over the ramp, which projects it well away from a simple vertical drop in a trajectory that makes sure it will fall into the water well away from the ship.

Unlike U.S. Pat. No. 3,675,257, the present invention includes holding means secured to one side of the ramp and holding lifebuoy marking means--e.g., either or both of a light signal device and a smoke signal device. It normally holds them vertically during stowage in an open-top tube or tubes, and it ejects and dumps them out into the water at the same time as the ejection of the life ring. In addition, the holding means provides a suitable compartment for stowing the painter line connecting the life ring to the marker or markers, and when the ramp ejects the life ring, the painter line is also ejected from its stowage compartment.

Other objects and advantages of the invention will appear from the following description of a preferred embodiment.

DESCRIPTION OF A PREFERRED EMBODIMENT

Figure 1:
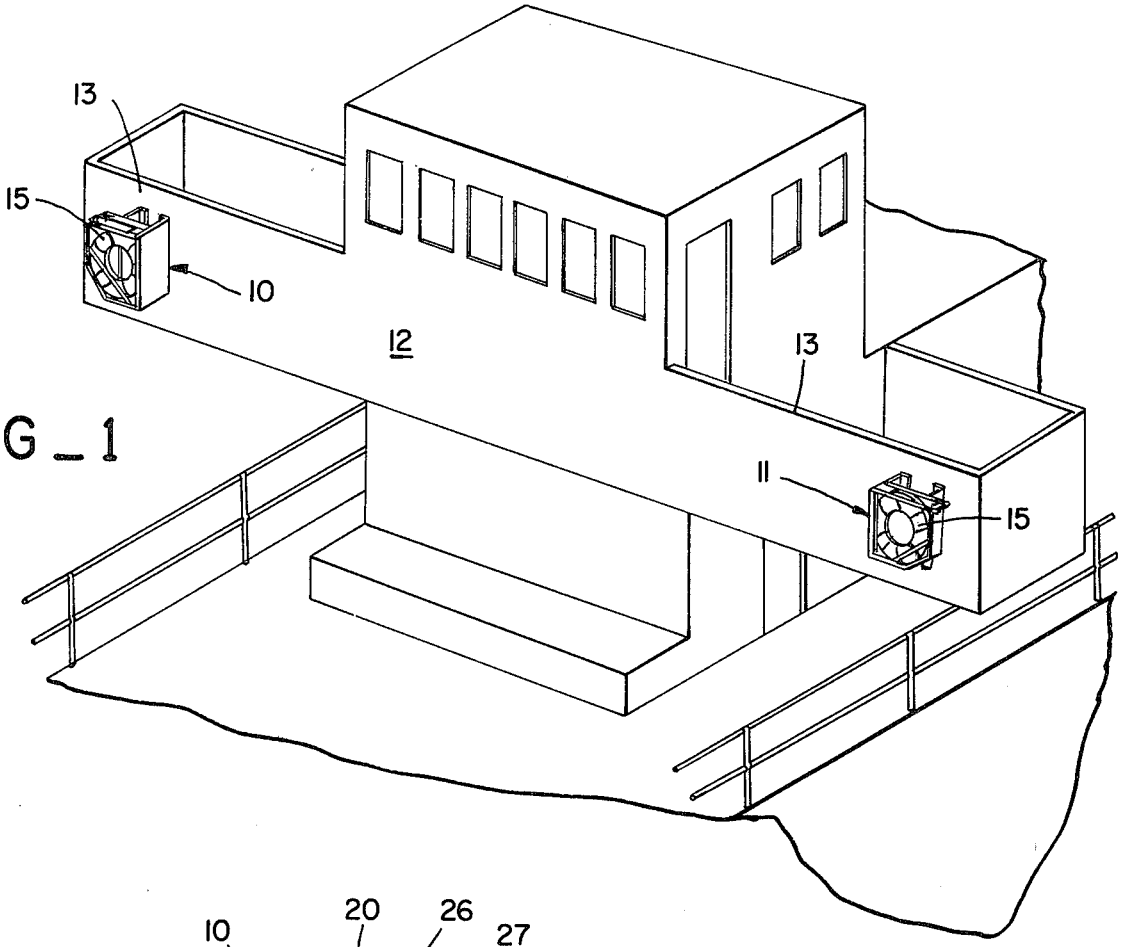
FIG. 1 is a view in perspective of a portion of a ship having some of the devices of the invention installed thereon.

Two assemblies 10 and 11 embodying the principles of the invention are shown in FIG. 1 installed on a transverse bulkhead 12 of a ship, just below the bridge railing 13. One is located on each side of the ship, so that there is usually one port and one starboard ring. Other locations may be additionally used, according to the desire of the ship owner and its master and the Coast Guard or other appropriate regulations. Each assembly 10, 11 holds a ring buoy 15 transverse to the fore-and-aft axis of the ship, and, upon release, the life ring 15 is propelled out from one end of the assembly 10 or 11 and is sent out away from the ship, and not simply dropped vertically.

The two assemblies 10 and 11 are symmetrical to each other, so that the description of one will suffice for both. The assembly 10 of FIGS. 2–7 comprises a suitable support and spacing members **16, 16*a* and 17; the support and spacing member 17 is preferably parallel to the support and spacing members 16 and 16*a* and the members 16 and 16*a* may be one continuous piece, if desired. The members 16, 16*a* and 17 may be made from sheet metal in sufficient width to space the ring buoy 15 a desired distance from the adjacent bulkhead 12, flanges 18, 18*a*, and 19 being secured to the bulkhead 12.**

A main frame 20 of the assembly 10 is secured to flanges **21, 21*a* and 22 of the spacing members 16 and 17. The main frame 20 has a stationary vertical end wall 23, against which the ring buoy 15 abuts, with flanges 23*a* and 23*b*, one of which is bolted to the flanges 21 and 21*a*. The main frame 20 also has a short horizontal bottom wall 24 with flanges 24*a* and 24*b* and a pair of horizontal upper angle irons 25 and 26 spaced apart by a member 27 which may be part of the end wall 23. Across the lower flanges 24*a* and 24*b* at their outboard end is secured a pivot rod 28.**

Figure 2:
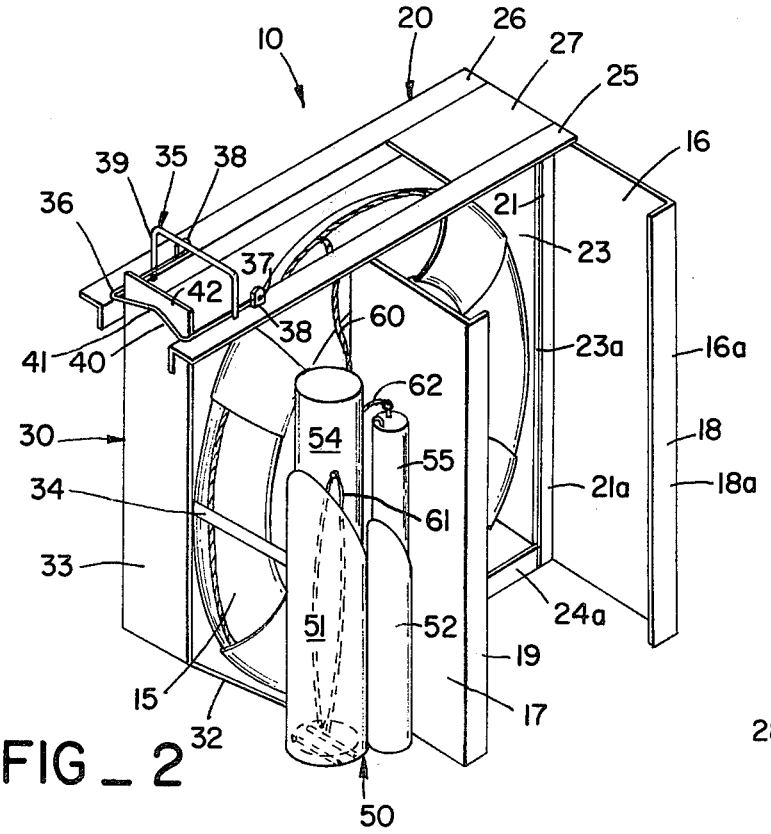
FIG. 2 is a view in perspective from the rear of a quick-release life ring assembly embodying the principles of the invention.
Figure 3:
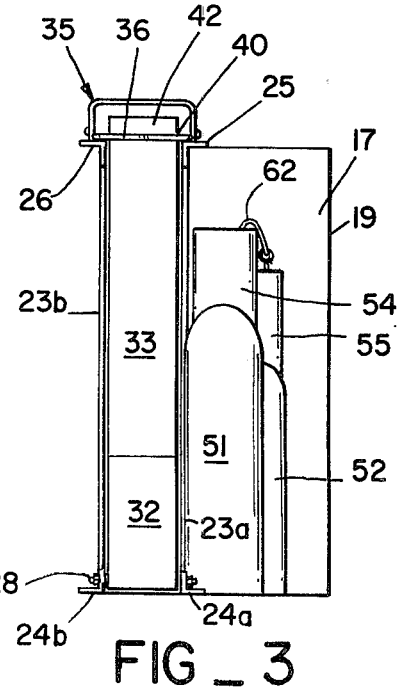
FIG. 3 is a view in end elevation of the assembly.
Figure 4:
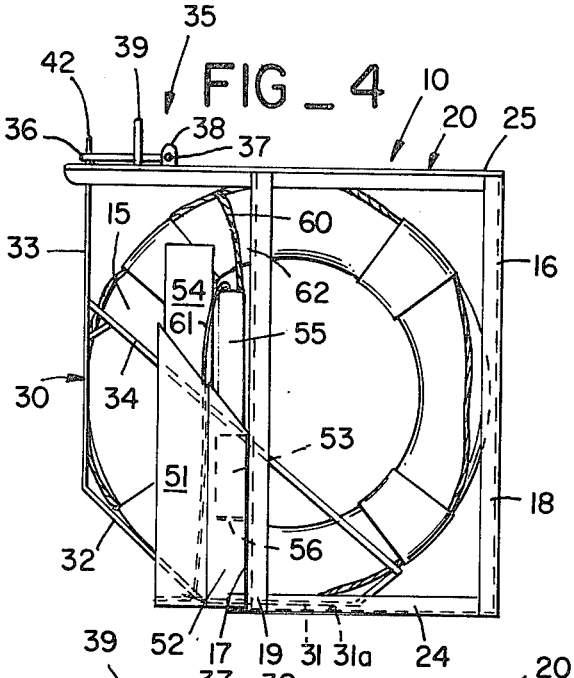
FIG. 4 is a view in rear elevation of the assembly of FIG. 2.

A swinging ramp and locking member 30 is pivoted on the rod 28 and has a normally horizontal bottom portion 31, an angularly extending portion 32, preferably about 45 degrees to the bottom portion 31, and a normally vertical end portion 33, the "normally horizontal" and "normally vertical" referring to the stowing position of FIGS. 2 and 3. The inclined portion 32 may be replaced with an arcuate curved portion. The ramp 30 is also provided with a pair of diagonal guide and retention members 34, one on each side that extend between the inner end of the bottom member 31 and an upper part of the end member 33, which help to hold the life ring 15 in place. The bottom portion 32 carries on its lower surface a rod or projecting portion 31*a* which seats firmly against the bottom wall 24, while the bottom portion 32 lies parallel to the wall 24.

Figure 5:
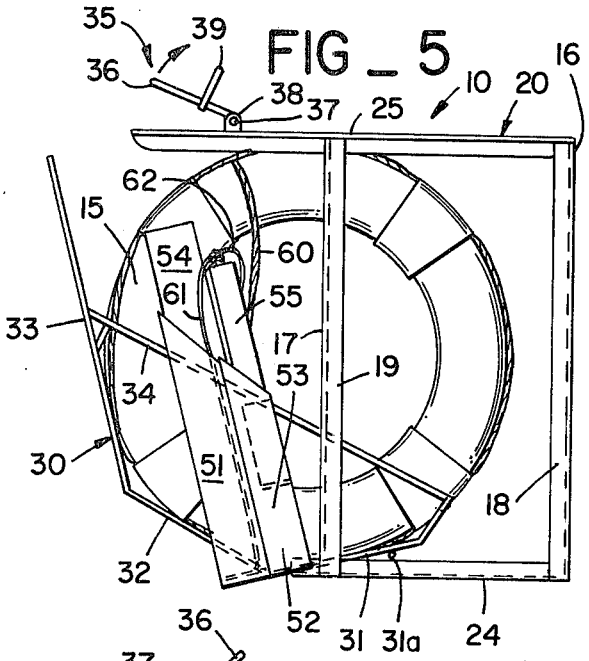
FIG. 5 is a view similar to FIG. 4 showing the assembly very soon after release has been obtained by pulling up on the handle.
Figure 7:
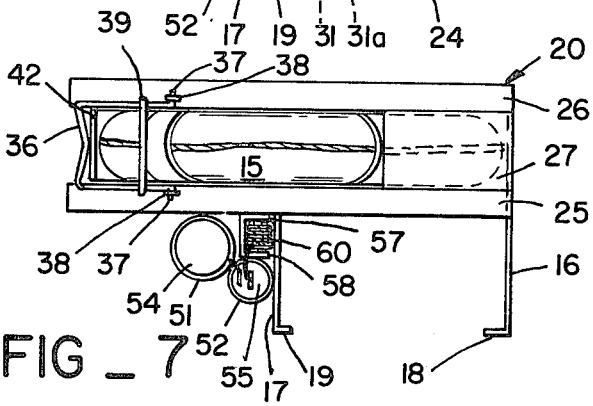
FIG. 7 is a top plan view of the assembly of FIG. 2.
Figure 6:
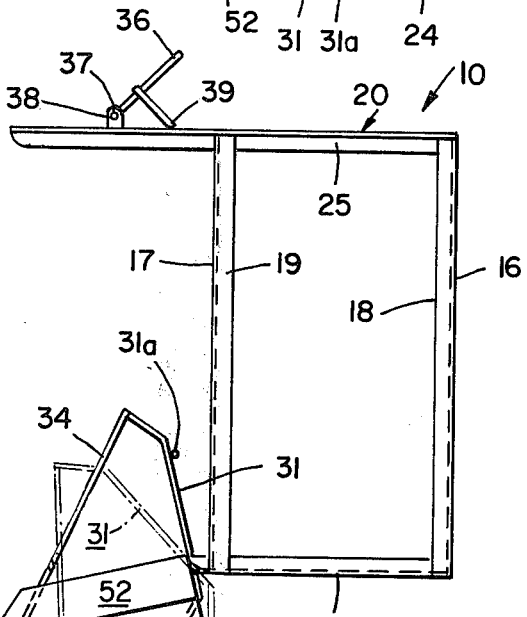
FIG. 6 is a view similar to FIG. 5 taken a few moments later with the ramp swinging to its lower position and the life ring leaving the ramp to follow a trajectory as though it were flung off board. In broken lines, the final position of the ramp is shown.
Figure 6:
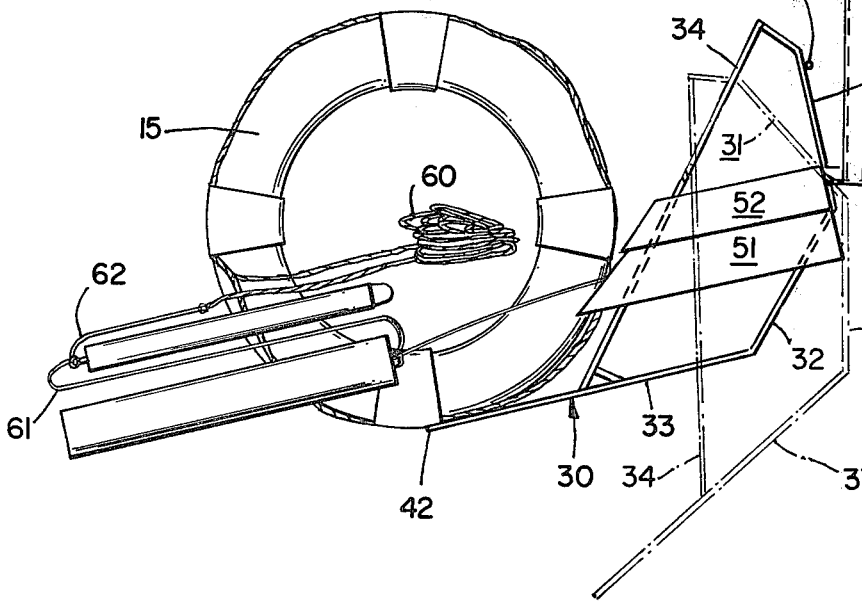

The ramp 30 is pivoted so that most of the weight of the ramp lies to one side of the pivot rod 28, to the left as is shown in FIGS. 2 through 6, so that when the ramp 30 is permitted to swing freely, it swings to the position shown approximately in broken lines in FIG. 6. The life ring 15 is mounted to bear on all three major portions: on the bottom 31, the inclined portion 32, and the end portion 33, which holds it also against the rear wall 23 of the stationary frame 20. The ramp 30 is retained in its stowing position by means of a latching and latch and release assembly 35, which may comprise a latch 36 with an M-like shape pivoted at its ends 37 to brackets 38 on the angle irons 25 and 26, and a handle 39 welded to the latch 36 at right angles to it. The M-shaped latch 36 has a central portion 40 which has a vertex 41 bearing with spring-like action on the end portion 33 of the ramp 30. An upward pull on the handle 39 pulls the latch 36 up above the upper edge 42 of the ramp 30 and lets the ramp 30 fall down.

Figure 8:
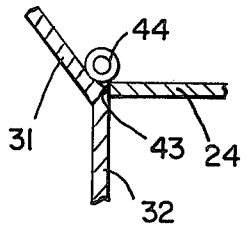
FIG. 8 is an enlarged view in section of a portion of FIG. 6.

Once the life ring 15 has been put in place, it is held there by the ramp 30 and the latch and release assembly 35, and once the latch 36 is released, as in FIG. 5, the ramp 30 swings down and the life ring 15 rolls along it and off, as shown in FIG. 6. What may not be completely apparent at first is that since the life ring 15 itself shifts its weight from primarily on the bottom ramp wall 31 to primarily on the inclined ramp wall 32 then later to the end ramp wall 33, it is already rolling, and the moving ramp 30 has a tendency to give the effect of throwing the life ring 15 overboard, even though everything is governed by the force of gravity. The gravitational forces act, in other words, not only on the ring buoy 15 but also on the ramp 30, so that the normally bottom wall 31 of the ramp 30 becomes a rear wall and helps to impel the ring 15, and so do the inclined wall 32 and the originally vertical wall 33. The projecting bar 31*a* helps on this too. The side members 34 retain the ring 15 in place during this time to assure that it will be projected off the end of the ramp 30. The final position of the ramp 33, as shown in broken lines in FIG. 6, may be governed by the edge 43 of the ramp 33 at the hinge 44. (See FIG. 8.)

In the present invention, the ramp 30 also supports holding means 50, comprising, for example, a pair of tubes 51 and 52 and a stowage compartment 53. The tube 51 may, for example, support a smoke signal device 54, holding it upside down and vertically. The tube 52 may, for example, hold an electric water light device 55 vertically. The compartment 53 may be defined by a horizontal wall 56 and two vertical walls 57 and 58, and it holds a painter line 60 that is secured to the life ring 15 at one end, and, at the other end (it is typically about 15 to 20 feet long) is secured to pull cables 61 and 62 which, respectively, will later serve to actuate the smoke signal device 54 and the electric water light 55. The devices 54 and 55 may be well-known conventional devices. The tubes 51 and 52 may be fabricated in various sizes and configurations to adapt to different signal devices, including new and better smoke and electric watertight devices not yet available which may come on the market in the future.

The point here is that where the ramp 30 is unlatched and swings down to eject the life ring 15, it also inverts the tubes 51 and 52 and opens and inverts the compartment 53 to eject the lifebuoy markers 54 and 55 into the water along with the painter line 60, and during their trajectory the devices 54 and 55 are actuated by pull on the cables 61 and 62. No chances are taken about possible failure of clips to release the markers 54 and 55 and everything happens as a completely coordinated action. The pull cables 61 and 62 are made of a length suitable to insure ejection without interference from the actuation devices and are suitably packed into the tubes 51 and 52 along with the markers 54 and 55.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. In a quick-release device for a ring buoy having spacing and support means for securing the device to a bulkhead, a stationary frame supported by said spacing and support means and providing a vertical end wall and pivot means spaced from said end wall, said ring buoy resting against said end wall, a swingable ramp pivoted to said pivot means with its center of gravity well beyond said pivot means on the opposite side thereof from said end wall, said ramp having a short bottom wall portion, and an end portion, which during stowage is substantially vertical and when vertical snugly holds said ring buoy, and a connecting portion joining said bottom wall portion to said end portion, with the ring buoy resting on the bottom portion and connecting portion of said ramp and against its said end portion, and latch and release means supported by an upper portion of said frame for engaging said ramp's end portion near an upper edge thereof when said end portion is vertical, and having release means for releasing said latch upon a simple upward pull, releasing said upper edge, the combination therewith of:

auxiliary, open-top, closed-bottom holding means secured to and movable with said ramp for loosely holding, to one side of said ring buoy and in a vertical position during stowage, lifebuoy marker means, said holding means also including a stowage compartment for a painter line secured to said ring buoy and to said marker means, whereby said ramp seeks its natural center of gravity and swings out around said pivot means and provides a ramp pathway projecting the ring buoy out and away from a vertical drop and causing it to describe a trajectory that frees it from the ship, and said holding means is simultaneously inverted to dump said lifebuoy marker means and said painter line and thereby to actuate said lifebuoy marker means.

2. The device of claim 1 wherein said marker means include pull-actuated actuating means, and two pull cable means having one end attached to said actuating means and another end fastened to said device.

3. In a quick-release device for a ring buoy having spacing and support means for securing the device to a bulkhead, a stationary frame supported by said spacing and support means and providing a vertical end wall and pivot means spaced from said end wall, said ring buoy resting against said end wall, a swingable ramp pivoted to said pivot means with its center of gravity well beyond said pivot means on the opposite side thereof from said end wall, said ramp having a short bottom wall portion, and an end portion, which during stowage is substantially vertical and when vertical snugly holds said ring buoy, and a connecting portion joining said bottom wall portion to said end portion, with the ring buoy resting on the bottom portion and connecting portion of said ramp and against its said end portion, and latch and release means supported by an upper portion of said frame for engaging said ramp's end portion near an upper edge thereof when said end portion is vertical, and having release means for releasing said latch upon a simple upward pull, releasing said upper edge, the combination therewith of:

auxiliary, open-top holding means secured to and movable with said ramp for holding, to one side of said ring buoy and in a vertical position during stowage, lifebuoy marker means, said holding means also including a stowage compartment for a painter line secured to said ring buoy and to said marker means, said marker means comprising smoke liberation means having a pull-actuated igniter means with a pull cable secured thereto, and electric watertight, light means having pull-actuated actuating means with a pull cable secured thereto, said painter line being secured to said ring buoy and to said pull cables, whereby when said ramp seeks its natural center of gravity and swings out around pivot means, it provides a ramp pathway projecting the ring buoy out and away from a vertical drop and causing it to describe a trajectory that frees it from the ship, and said holding means is simultaneously inverted to dump said lifebuoy marker means and said painter lines and thereby to actuate both said lifebuoy marker means.

4. The device of claim 3 wherein said auxiliary, open-top holding means comprise a pair of open-top tubes side-by-side.

* * * * *